US011371237B2

(12) United States Patent
Danna et al.

(10) Patent No.: US 11,371,237 B2
(45) Date of Patent: Jun. 28, 2022

(54) METHODS OF MAKING AND INSTALLING A CONCRETE EXPANSION JOINT INSERT INCLUDING A SEALANT ON ONE EDGE

(71) Applicant: JD RUSSELL COMPANY, Utica, MI (US)

(72) Inventors: Nicholas Danna, Tucson, AZ (US); Bradley Danna, Shelby Township, MI (US); Marc Danna, Tucson, AZ (US)

(73) Assignee: JD RUSSELL COMPANY, Utica, MI (US)

( * ) Notice: Subject to any disclaimer, the term of this patent is extended or adjusted under 35 U.S.C. 154(b) by 64 days.

(21) Appl. No.: 17/079,620

(22) Filed: Oct. 26, 2020

(65) Prior Publication Data

US 2021/0040726 A1 Feb. 11, 2021

Related U.S. Application Data

(62) Division of application No. 15/836,040, filed on Dec. 8, 2017, now Pat. No. 10,815,658.

(60) Provisional application No. 62/432,096, filed on Dec. 9, 2016.

(51) Int. Cl.

| | |
|---|---|
| ***E04B 1/68*** | (2006.01) |
| ***E01C 11/10*** | (2006.01) |
| ***E01C 11/06*** | (2006.01) |

(52) U.S. Cl.

CPC ..... *E04B 1/6803* (2013.01); *E01C 11/106* (2013.01); *E04B 1/6801* (2013.01); *E01C 11/06* (2013.01)

(58) Field of Classification Search

CPC .... E01C 11/04; E01C 11/106; E01C 23/0973; E01C 23/16; E04B 1/68; E04B 1/6812; E04B 1/6801; E04B 1/6803

See application file for complete search history.

(56) References Cited

U.S. PATENT DOCUMENTS

| | | | |
|---|---|---|---|
| 1,329,631 | A | 2/1920 | Riehle |
| 1,503,942 | A | 8/1924 | Fischer |
| RE16,554 | E | 2/1927 | Fischer |
| 1,770,361 | A | 7/1930 | Fischer |
| 1,800,193 | A | 4/1931 | Fischer |
| RE18,765 | E | 3/1933 | Fischer |
| 2,023,529 | A | 12/1935 | Jussen |
| 3,330,187 | A | 7/1967 | Kohler |
| 3,334,557 | A | 8/1967 | Fitzgibbon |
| 3,418,899 | A | 12/1968 | Fujihara |
| 3,455,215 | A | 7/1969 | Webb |
| 3,629,986 | A | 12/1971 | Klittich |
| 3,953,661 | A | 4/1976 | Gulley |
| 4,058,947 | A | 11/1977 | Earle |
| 4,131,382 | A | 12/1978 | Hymo |
| 4,181,711 | A | 1/1980 | Ohashi |
| 4,401,716 | A | 8/1983 | Tschudin-Mahrer |
| 4,601,604 | A | 7/1986 | Clark et al. |

(Continued)

*Primary Examiner* — Abigail A Risic

(74) *Attorney, Agent, or Firm* — Carlson, Gaskey & Olds, P.C.

(57) ABSTRACT

An illustrative example method of making a concrete expansion joint insert includes establishing an insert body having two ends, two longitudinal edges between the ends, and two side surfaces between the longitudinal edges and the ends. A sealant is secured to one of the longitudinal edges so that the insert and the sealant can be simultaneously inserted into an expansion joints.

15 Claims, 3 Drawing Sheets

(56) References Cited

U.S. PATENT DOCUMENTS

| | | | | |
|---|---|---|---|---|
| 4,740,404 | A | 4/1988 | Otsugu | |
| 4,817,963 | A | 4/1989 | Munden | |
| 4,824,283 | A | 4/1989 | Belangie | |
| 4,927,291 | A | 5/1990 | Belangie | |
| 5,130,176 | A | 7/1992 | Baerveldt | |
| 5,190,395 | A | 3/1993 | Cathey | |
| 6,491,468 | B1 | 12/2002 | Hagen | |
| 6,534,147 | B2 | 3/2003 | Gopalan | |
| 6,616,877 | B2 | 9/2003 | Close et al. | |
| 9,822,499 | B2 | 11/2017 | Yan | |
| 2001/0030023 | A1 | 10/2001 | Tippett | |
| 2004/0035075 | A1 | 2/2004 | Trout | |
| 2004/0187235 | A1 | 9/2004 | Elias | |
| 2005/0180818 | A1 | 8/2005 | Beloreshka | |
| 2006/0117692 | A1 | 6/2006 | Trout | |
| 2007/0151185 | A1* | 7/2007 | Robinson | E01C 11/10 52/396.04 |
| 2008/0197576 | A1 | 8/2008 | Trout | |
| 2008/0268231 | A1 | 10/2008 | Deib | |
| 2010/0307102 | A1 | 12/2010 | Barnett | |
| 2017/0044757 | A1 | 2/2017 | Shin | |
| 2017/0121918 | A1 | 5/2017 | Yan | |

* cited by examiner

METHODS OF MAKING AND INSTALLING A CONCRETE EXPANSION JOINT INSERT INCLUDING A SEALANT ON ONE EDGE

CROSS REFERENCE TO RELATED APPLICATIONS

This application is a divisional of U.S. patent application Ser. No. 15/836,040, filed on Dec. 8, 2017, now U.S. Pat. No. 10,815,658, which claims priority to U.S. Provisional Application No. 62/432,096, which was filed on Dec. 9, 2016.

BACKGROUND

Concrete has been in widespread use for a variety of surfaces, including roads and walkways. Given that concrete is a generally porous material and is exposed to changing weather conditions, expansion or contraction joints between sections or slabs of the concrete accommodate expansion and contraction of the concrete. For discussion purposes, the phrases "expansion joint," "contraction joint," or "concrete joint," within this document should be considered to be interchangeable unless a particular context requires a different understanding.

Many expansion joints include an insert or filler within the space between the sections or slabs of concrete. Traditional joint inserts were made using materials such as wood, paper and asphalt. More recently, recycled rubber expansion joint inserts were introduced.

U.S. Pat. No. 6,616,877 describes a technique for using recycled rubber, such as that available from used vehicle tires, for making concrete expansion joint material. According to the teachings of that document, relatively large sheets of recycled rubber-based material can be cut to a desired size for different installations to accommodate different thicknesses of concrete, for example.

In many installations, after the concrete has cured at least one individual and often a work crew returns to the jobsite to install a sealant in the expansion joints. The sealant is intended to form a barrier to prevent moisture from entering the expansion joint space. The sealant is often applied with a sprayer or application gun in fluid form to fill the expansion joint space between the concrete slabs or sections that is not occupied by the expansion joint insert.

Alternatively, sealant is available in a roll or rope form that is installed on top of the expansion joint insert after the concrete has cured. Such sealant may be heated so that it melts sufficiently to seal the upper portion of the expansion joint.

One of the difficulties associated with returning to the jobsite and applying a fluid sealant is that it is possible to get the sealant on the concrete outside of the expansion joint, which leaves the jobsite looking messy and unprofessional. Additionally, the time required for applying such a sealant introduces additional expense. A difficulty associated with the roll or rope form of sealant is that it tends to be difficult to handle and that increases the time required to complete the task of installing the sealant.

Another issue presented by the conventional approach is that a portion of the expansion joint insert material must be removed along the entire length of the expansion joint to create a cavity for receiving the sealant material. This increases the time and labor expense.

There is a need for a better way to achieve a sealed expansion joint.

SUMMARY

An illustrative example embodiment of a concrete joint insert includes a body having two ends, two longitudinal edges between the ends and two side surfaces between the longitudinal edges. A sealant is secured to one of the longitudinal edges so that the insert and the sealant can be simultaneously installed at the location of a concrete joint.

An illustrative example method of making a concrete expansion joint insert includes establishing an insert body having two ends, two longitudinal edges between the ends, and two side surfaces between the longitudinal edges and the ends. The method includes securing a sealant to one of the longitudinal edges so that the insert and the sealant can be simultaneously inserted into an expansion joint.

An illustrative example method of finishing an expansion joint in a slab of concrete includes placing an expansion joint insert in the expansion joint. The expansion joint insert has a body and a sealant along at least one edge of the body prior to being placed in the expansion joint. Placing the expansion joint insert into the expansion joint includes orienting the sealant to be exposed along the expansion joint. The method includes subsequently heating the sealant to at least partially melt the sealant to cause the sealant to establish a seal across at least a portion of the expansion joint.

Various features and advantages will become apparent to those skilled in the art from the following detailed description of example embodiments. The drawings that accompany the detailed description can be briefly described as follows.

DETAILED DESCRIPTION

Figure 1:
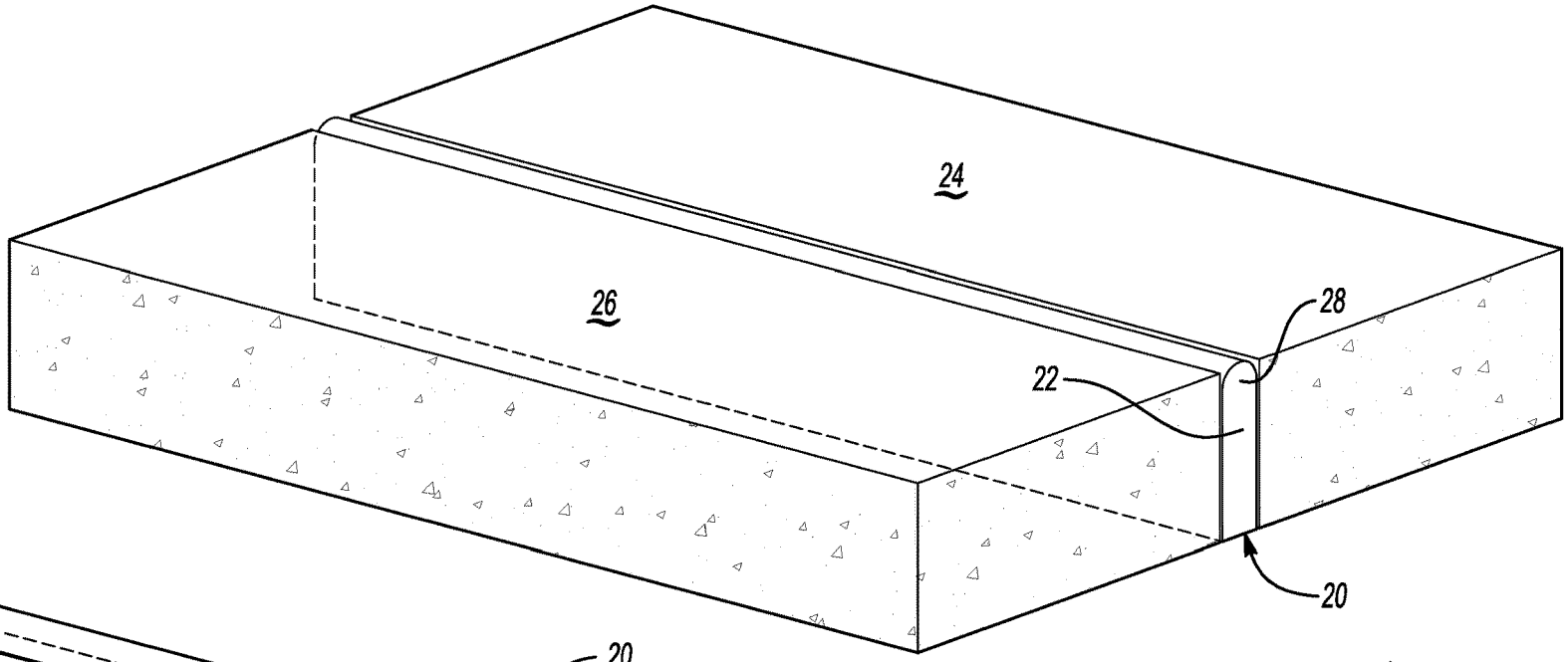
FIG. 1 diagrammatically illustrates a concrete joint including an insert with a sealant on one edge designed according to an embodiment of this invention.

FIG. 1 shows a concrete joint insert 20 within an expansion joint 22 between two sections or slabs of concrete 24 and 26. A sealant 28 is situated on the insert 20 along an upper portion of the expansion joint 22.

Figure 2:
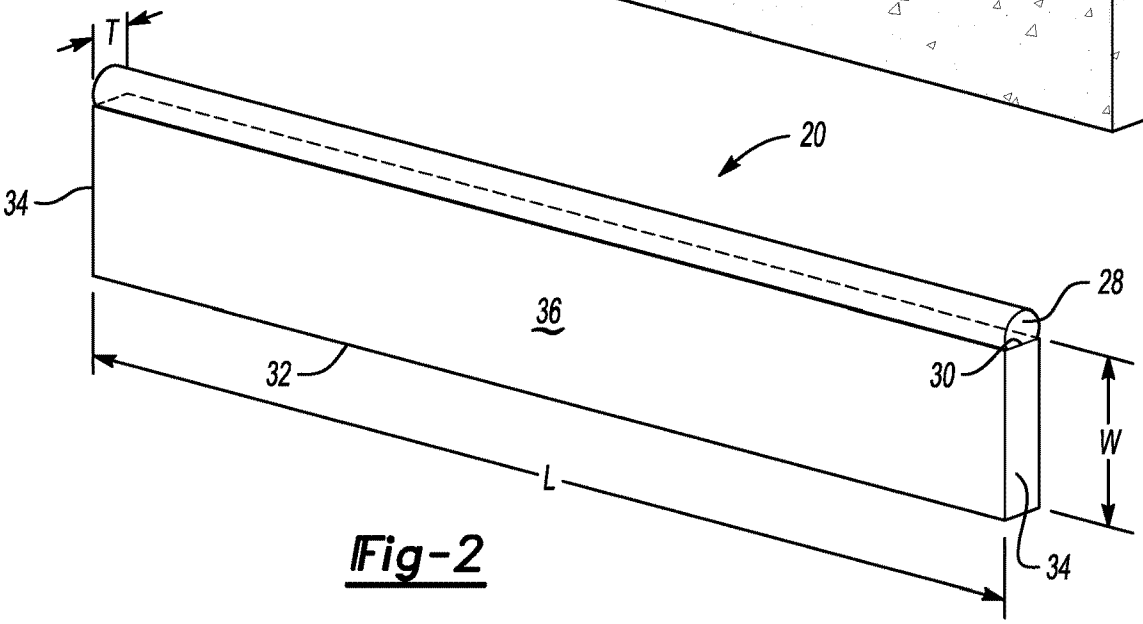
FIG. 2 is a perspective illustration of an example embodiment of a concrete joint insert.

FIG. 2 illustrates an example embodiment of a concrete joint insert 20 including sealant 28 on the insert 20 before it is delivered to a jobsite or installed in an expansion or contraction joint. In this example, the insert 20 includes a body having longitudinal edges 30 and 32 that extend between ends 34 of the body. Side surfaces 36 are between the longitudinal edges 30 and 32 and between the ends 34. Only one of the side surfaces 36 is shown in the illustration of FIG. 2.

The insert 20 of FIG. 2 has a width W, a thickness T, and a finished length L. The length L and thickness T correspond to dimensions of the longitudinal edges 30 and 32, respectively. The sealant 28 in this example has the same length L and thickness T. The thickness T and width W correspond to dimensions of the ends 34. The width W and length L correspond to dimensions of the side surfaces 36.

In some examples, the width W varies between two inches and twelve inches. Many concrete installations include slabs that have a thickness on the order of 3.5 inches, 4 inches or 6 inches. The width W is selected to correspond to the thickness of the concrete in such examples.

The thickness T may vary between 0.25 inches and 1 inch. Many expansion joints have a gap size of approximately one-half inch and the insert 20 will have a thickness T of one-half inch for such installations.

The insert 20 may comprise various materials. In some examples, the insert comprises recycled rubber while in other embodiments the insert comprises one of: wood fibers impregnated with asphalt, asphalt with minerals such as sand added between two layers of tar paper, recycled newspaper bonded under pressure and containing wax, recycled vinyl, cork, rebounded rubber, or neoprene and wood strips.

Figure 3:
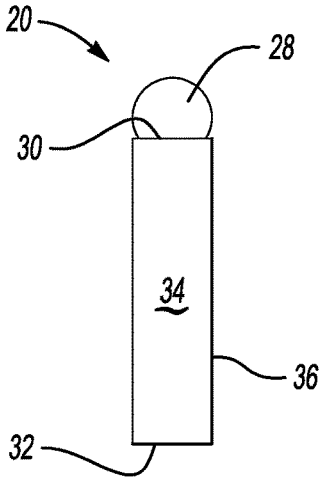
FIG. 3 is an end view of an example embodiment.

FIG. 3 is an end view of the embodiment shown in FIG. 2. The sealant 28 is situated along the longitudinal edge 30 with the sealant material exposed. In this example, during application, the sealant material 28 adheres to the longitudinal edge 30 without requiring any additional adhesive. The sealant material of the sealant 28, itself, is sufficiently tacky for the sealant 28 to remain in place on the longitudinal edge 30.

One example sealant 28 has a material composition like that of a commercially available concrete joint and crack filler material sold by Dalton Industries under the tradename CRACKSTIX™.

In some examples, the adhesive material will have an exterior tackiness. The embodiment of FIG. 4 includes a cap or cover 40 over the sealant 28 to avoid adhesion during handling or storage. In one example, the cover 40 is a thin layer or film of plastic material that may be melted with the adhesive when the insert is in place between slabs of concrete. Some polymer films used as the cap or cover 40 will eventually disappear after being exposed to outdoor weather conditions. For example, the cap or cover may dissipate, disintegrate, evaporate or melt over time. Given this description, those skilled in the art will be able to select an appropriate material to prevent undesired adhesion between the sealant 28 and any object or surface that contacts the sealant 28 before installation. The cover material is durable enough to protect against adhesion during production, packaging, storage and transport to a job site while allowing for eventual, desired exposure of the sealant 28.

Figure 4:
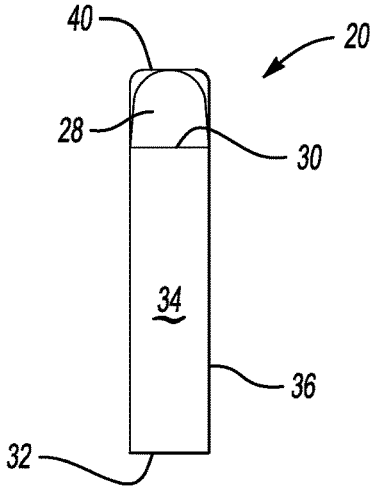
FIG. 4 is an end view of another example embodiment.

In some example embodiments as shown in FIG. 4, the sealant 28 holds an established shape in ambient conditions. For example, the sealant 28 establishes a relatively stiff, flat surface along the top of the insert 20.

In some embodiments, the sealant 28 comprises a material that has a hardness sufficient for retaining an established shape in ambient temperature conditions. In some embodiments, the sealant material is capable of retaining a desired shape in temperatures up to approximately 160° F. With these characteristics, the sealant 28 holds its established shape throughout shipping, handling and installation. Even though such materials may be melted by applying heat, in some embodiments, after being melted, the material cures and has a hardness that is at least the same as used for maintaining the shape prior to installation. In some embodiments, curing the sealant 28 by applying heat when the sealant has been installed results in a greater hardness at the installation site compared to the hardness of the sealant 28 during shipping and handling, for example.

Figure 5:
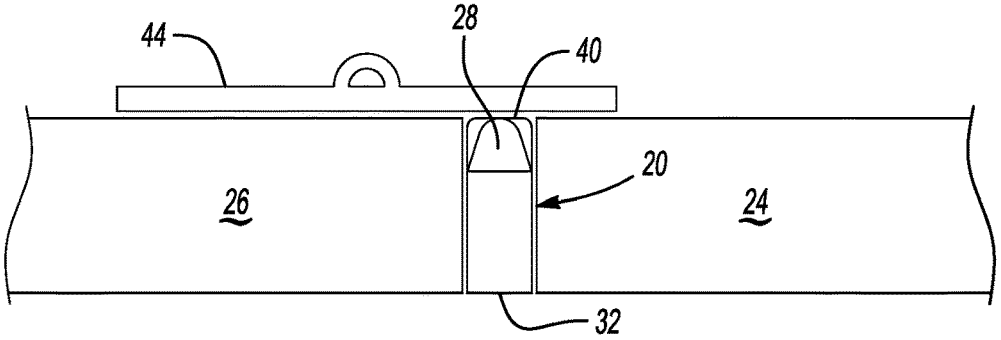
FIG. 5 schematically illustrates a feature of an example embodiment of an insert in use.

One example use is schematically represented in FIG. 5 where a screed tool 44 is pulled along the top surface of the concrete during installation to establish a level, finished surface on the concrete. The sealant 28, when covered with the cap or cover 40, provides a rigid guide surface along which an individual may pull or push the screed tool 44. In this example, the sealant 28 facilitates achieving a desired finish surface on the concrete that is installed with the insert 20 in place during installation.

Figure 6:
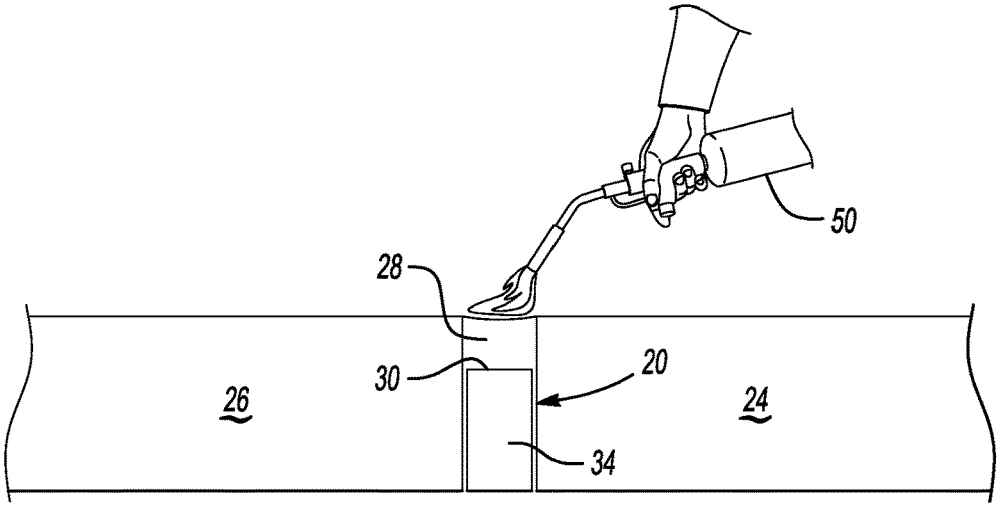
FIG. 6 schematically illustrates a portion of an installation technique.

FIG. 6 schematically illustrates an individual using a heat source 50, such as a torch, for heating the adhesive 28 when the insert 20 is in the expansion joint 22 between the slabs of concrete 24 and 26 after the concrete has cured. Heating the adhesive 28 causes the adhesive to at least partially melt and seal off the top portion of the expansion joint 22 above the body of the insert 20. With embodiments of this invention, concrete installers may place the expansion joint inserts 20 within expansion joints with the adhesive 28 already secured to the body of the insert 20. The final sealing of the expansion joints is simpler because all that is required after the concrete has cured is for an individual to heat the sealant 28 to at least partially melt it for sealing off the top portion of the expansion joint.

Figure 7:
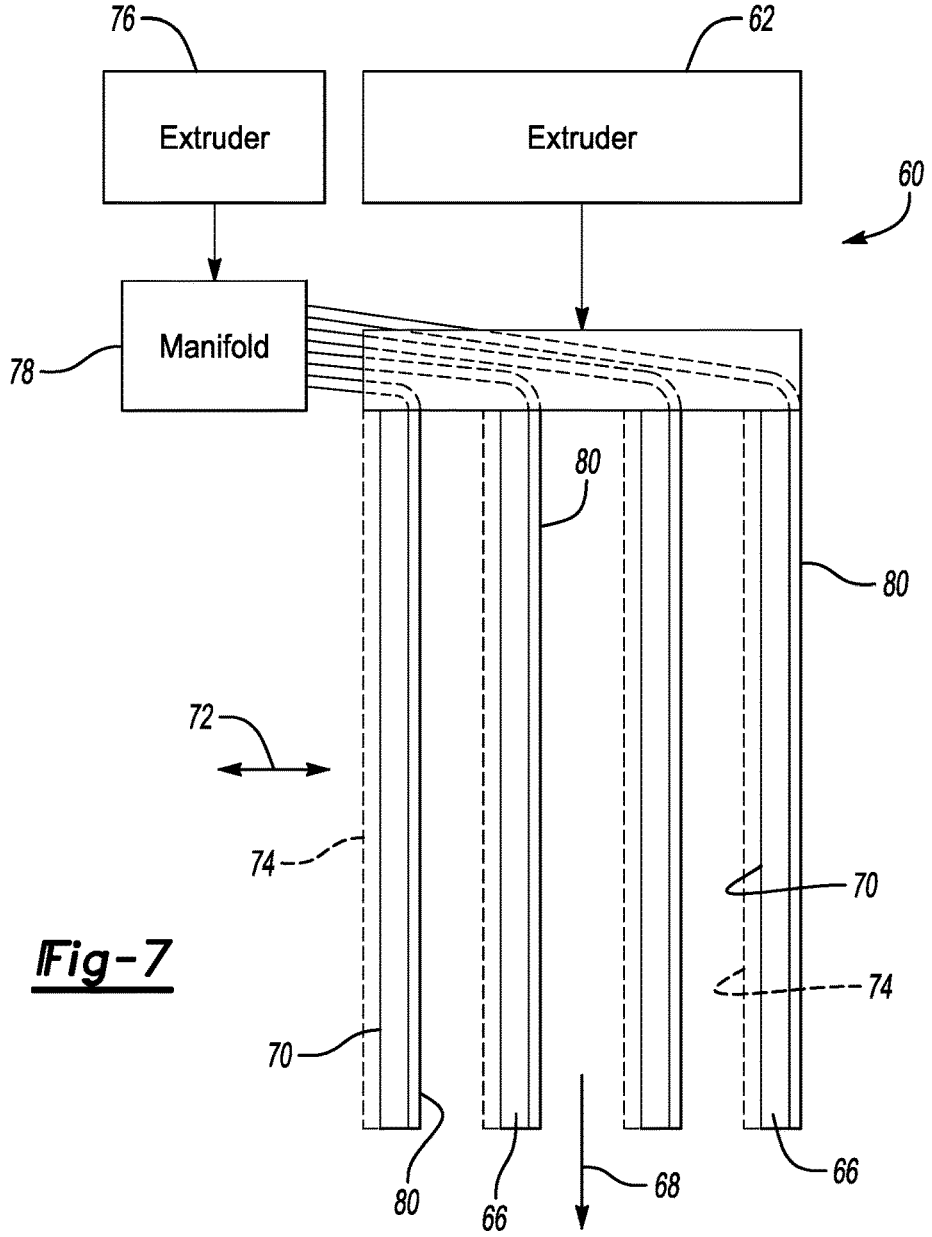
FIG. 7 schematically illustrates a device for manufacturing concrete joint inserts according to an example embodiment.

In some embodiments of this invention, the insert 20 is cut from a larger sheet to achieve the desired width W while in others, the width W and thickness T are established during a molding process, depending on the material chosen from those mentioned above. FIG. 7 schematically illustrates a device 60 useful for manufacturing inserts 20 having width W and thickness T dimensions that are preset to correspond to the dimensions desired for installation. In other words, the device 60 provides elongated strips of insert material instead of generating or yielding a sheet of material that is subsequently cut into strips.

The device 60 includes an extruder 62 for extruding material, such as recycled rubber into a manifold 64 that distributes the extruded material into individual channels 66. The material flows through the channels 66 in the direction shown by the arrow 68. The channels in this example have an adjustable dimension to achieve different width W dimensions of the inserts.

One side 70 of each channel 66 is adjustable relative to an opposite side of the channel as schematically shown by the arrow 72. The side 70 of each channel 66 may be adjusted from a smaller width W dimension to a larger width W dimension as schematically shown in phantom at 74. The adjustable feature of the channels 66 allows for making different sized inserts without requiring a completely separate die channel and without requiring complex changes to the device 60.

The device 60 includes the ability to provide the sealant 28 along at least one of the longitudinal edges of an insert produced by the device 60. In the illustrated example, another extruder 76 extrudes sealant material into a manifold 78 that distributes the sealant material along secondary channels 80 that are situated along one of the longitudinal edges of the channels 66. Such an arrangement allows for coextruding two materials so that at least one longitudinal edge of the molded insert has the sealant 28 in place on the longitudinal edge.

Figure 8:
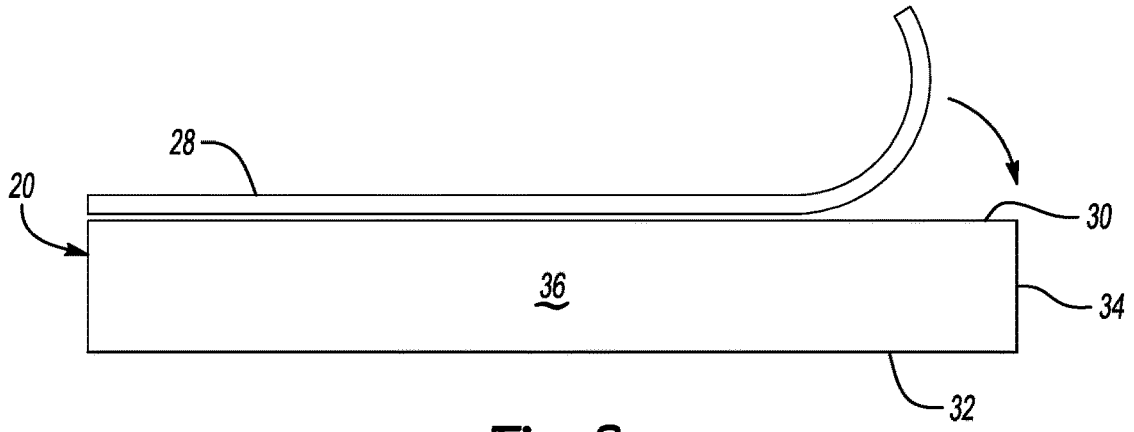
FIG. 8 schematically illustrates a technique for assembling an insert designed according to an embodiment of this invention.

FIG. 8 schematically illustrates another technique for making an expansion joint insert 20 according to an embodiment of this invention. In this example, the body of the insert 20 is already established. In some examples, a molding process will form the body having the desired dimensions. In another example, the body of the insert 20 is cut from a larger sheet of material. Regardless of how the body of the insert 20 is established, according to FIG. 8 the adhesive 28 is applied after the body already has its desired dimensions.

In some examples, the adhesive 28 is applied by attaching a rope or bead of adhesive material to the longitudinal edge 30. In other examples, the adhesive material 28 is applied using a fluid form of the adhesive and an applicator. In such examples, while the adhesive is fluid, there is enough solidity to it once the material leaves the applicator that the material remains in a desired position relative to the rest of the insert body until the adhesive material cures. Some examples include placing the insert body within a molding station and then molding the adhesive material onto the longitudinal edge 30.

In some embodiments, once the sealant 28 material is applied to the selected edge of the insert, the sealant 28 is cooled and shaped to a desired configuration. Some examples include using rollers that establish the desired profile or shape of the sealant 28. Once shaped, the sealant 28 is cooled and is ready for the cap or cover 40 to be applied. In one example, a film is draped over the top edge of the sealant 28 and extends down the sides toward the insert body a sufficient length to cover all exposed surfaces of the sealant 28.

Including an adhesive 28 on a longitudinal edge 30 of an expansion joint insert 20 facilitates faster installation and more consistent finished results. The amount of adhesive within each joint is controlled because the adhesive material is already present on the insert before it is installed in an expansion joint between sections of concrete. This avoids misapplication or under-application where insufficient amounts of adhesive are otherwise present in an expansion joint, which may lead to future deterioration of the concrete along that joint. Additionally, having a controlled amount of adhesive within the expansion joint facilitates achieving a more consistent and aesthetically pleasing appearance to the finished concrete installation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of making a concrete expansion joint insert, the method comprising:

establishing an insert body having two ends, two longitudinal edges between the ends, and two side surfaces between the longitudinal edges and the ends; and securing a sealant to one of the longitudinal edges so that the insert and the sealant can be simultaneously inserted into an expansion joint, wherein the sealant includes an upwardly facing sealant surface that has an adhesive tackiness.

2. The method of claim 1, comprising simultaneously establishing the insert body and securing the sealant to the one of the longitudinal edges.

3. The method of claim 2, wherein securing the sealant to the one of the longitudinal edges comprises coextruding the sealant and a material to establish the insert body.

4. The method of claim 1, comprising establishing the insert body before securing the sealant to the one of the longitudinal edges.

5. The method of claim 4, wherein the insert body has a length between the two ends, a width between the two longitudinal edges and thickness between the two side surfaces;

establishing the insert body comprises cutting a portion of a sheet that has the thickness such that the resulting cut portion of the sheet has the length and width of the insert body; and securing the sealant to the one of the longitudinal edges after the cutting.

6. The method of claim 1, wherein the sealant has a hardness sufficient to maintain a selected shape in ambient conditions prior to being installed in a concrete joint.

7. The method of claim 6, wherein the sealant has a melting temperature at which the sealant will at least partially melt and change from the selected shape to another configuration.

8. The method of claim 7, wherein the melting temperature is above 160° F.

9. The method of claim 1, comprising placing a cover over the sealant surface after securing the sealant to the one of the longitudinal edges.

10. The method of claim 9, wherein the cover comprises a film.

11. The method of claim 9, wherein the cover is configured to be reduced or removed in response to exposure to an outdoor environment.

12. The method of claim 9, comprising removing the cover after a selected time.

13. A method of finishing an expansion joint in a slab of concrete, the method comprising:

placing an expansion joint insert in the expansion joint, the expansion joint insert having a body and a sealant along at least one edge of the body prior to being placed in the expansion joint, wherein placing the expansion joint insert includes orienting the sealant to be exposed along the expansion joint; and subsequently heating the sealant to at least partially melt the sealant to cause the sealant to establish a seal across at least a portion of the expansion joint.

14. The method of claim 13, wherein the sealant includes an exposed sealant surface that faces in an upward direction as a result of the placing, and the exposed sealant surface has an adhesive tackiness prior to the heating.

15. The method of claim 13, wherein the heating establishes a finish profile of the sealant along the expansion joint.

* * * * *